United States Patent [19]

Murray, III

[11] Patent Number: 5,027,992

[45] Date of Patent: Jul. 2, 1991

[54] CONNECTOR HEADGEAR

[76] Inventor: Edward F. Murray, III, 2741 Plainview Rd., Cheyenne, Wyo. 82001

[21] Appl. No.: 484,417

[22] Filed: Feb. 23, 1990

[51] Int. Cl.[5] ..... A42B 7/00

[52] U.S. Cl. ..... 224/181; 273/DIG. 17; 446/27; D2/263; 2/DIG. 11

[58] Field of Search ..... 224/181; 40/329, 586, 40/218; 116/173, 209; D2/509, 263, 250; 2/209.1, 209.2, 199, 185 R, DIG. 11; 446/27, 26; 248/181; 128/866, 867, 207.18; 273/DIG. 17, DIG. 19

[56] References Cited

U.S. PATENT DOCUMENTS

| | | | |
|---|---|---|---|
| D. 155,437 | 10/1949 | Molin et al. | 446/27 |
| D. 283,233 | 4/1986 | Horwitz | D21/59 |
| D. 287,891 | 1/1987 | Cavaliere | D2/250 |
| 1,715,331 | 5/1929 | Richter | 2/185 R |
| 2,604,818 | 7/1952 | Morgenstern | 248/181 |
| 2,679,711 | 6/1954 | Learnard | 116/173 |
| 2,908,519 | 10/1959 | Holden | 248/181 |
| 3,028,059 | 4/1962 | Greenwood | 224/181 |
| 3,031,681 | 5/1962 | Hoeflich | 2/198 |
| 3,104,644 | 9/1963 | Burton | 116/209 |
| 3,184,884 | 5/1965 | Petrucelli | 273/10 |
| 3,213,823 | 10/1965 | Levy et al. | 116/173 |
| 3,254,444 | 6/1966 | Paterson | 2/199 |
| 3,360,801 | 1/1968 | Parrilla | 2/199 |
| 4,447,250 | 5/1984 | Wolens et al. | 2/199 |
| 4,488,372 | 12/1984 | Lowen | 446/27 |

FOREIGN PATENT DOCUMENTS

| | | | |
|---|---|---|---|
| 252296 | 5/1926 | United Kingdom | 273/DIG. 17 |

*Primary Examiner*—Charles E. Phillips
*Assistant Examiner*—Keith Kupferschmid
*Attorney, Agent, or Firm*—Dean P. Edmundson

[57] ABSTRACT

Connector headgear which includes a headband, at least one stem or upright for supporting a light-weight display item, and attachment mechanism for attaching the stem to the headband. The stem can be removed and replaced, as desired, to display different types of objects which are light in weight. Preferably, more than one stem can be attached to the headband, e.g., to display multiple light-weight items simultaneously.

15 Claims, 5 Drawing Sheets

CONNECTOR HEADGEAR

FIELD OF THE INVENTION

This invention relates to connector headgear. In another aspect this invention relates to headgear of the type utilizing a headband. More particularly, this invention relates to a headband utilizing versatile connectors enabling the wearer to connect and disconnect a large variety of objects, as desired.

BACKGROUND OF THE INVENTION

There are several varieties of objects custom made or mass produced that come fastened to an end of a straw, stem or a stick. These items include, but are not limited to, mini mylar or latex balloons, mini flags and pennants, specialty signs (custom or commercial), specialty design items (custom or commercial), ornamentation, artificial flowers, and so forth. These types of items have been commonly used as a method to attract or signal attention such as in the field of specialty advertising to display logos, trademarks and trade names. Within the last several years, however, there has been a tremendous expansion in the use of these objects as a mode of expression or communication. For example, the mylar balloon manufacturers are now producing millions of "mini" (approximately 2 inches to 9 inches in diameter) mylar balloons in all shapes and sizes upon which are displayed literally hundreds of different themes ranging from holidays (Christmas, New Year's, Valentine's Day, etc.) and special occasions (birthdays, anniversaries, weddings, etc.) to events (political, sports, concerts, etc.) and specialty themes (animals, cartoons, product licensing). The use of the other items such as mini flags and pennants, specialty signs, specialty design items, and other types of ornamentation has expanded in much the same way.

Such display items, which are very light in weight, are fastened to an end of a "stick", "straw", or "stem" (hereinafter collectively referred to as "stems") which are usually composed of plastic or wood. The stems may be tubular or solid and range in diameter from approximately 1/16 inch to ¼ inch depending on the maker and the item attached. Previously, an individual would have to hold the stem with his or her hand(s) if a person wanted to carry and display the object. Holding the stem in one's hand(s), however, limits that person's ability to use his or her hands for some other purpose.

Connector headgear of this invention represents the first product enabling the wearer to:

(a) connect to the headgear a variety of display objects fastened to stems of different diameters, as desired;

(b) increase or decrease the number of objects connected to the headgear for display, as desired;

(c) change the type of object(s) connected to the headgear for display, as desired;

(d) change the position of the object(s) connected to the headgear for display, as desired; and (e) hold and display such object(s) suspended on a stem above the wearer's head without having to use his or her hand(s).

SUMMARY OF THE PRESENT INVENTION

In accordance with the present invention there is provided connector headgear comprising a generally U-shaped headband of the type which can be worn on the head of the user. The headband is preferably made of flexible plastic or the like and is held in place on the head due to the inherent resilient nature of the headband.

In on embodiment the connector headgear comprises:

(a) a U-shaped headband for resiliently gripping the head of a wearer;

(b) at least one stem member having upper and lower ends, and further including a display item, light in weight, carried by the upper end thereof;

(c) connector means for connecting and disconnecting the lower end of the stem member to the headband.

Preferably the headband includes a plurality of slots or apertures which facilitate attachment of one or more retainers to the headband at various positions. Preferably, a retainer grips the lower portion of a connector which is preferably ball-shaped or spherical thereby enabling said connector to rotate and pivot within the retainer. The upper portion of the connector is generally tubular permitting the lower end of a stem member to be inserted into it. Stem members of different diameters can be inserted into the versatile connector. Various types of light-weight display items can be carried by the upper end of the stem member(s), e.g., flags, pennants, balloons, mistletoe, flowers, badges, signs, pinwheels, specialty design items, etc. Stem members of different diameters can be accommodated.

Thus, a single connector headgear may be used by a variety of people in order to connect a variety of objects, in a variety of ways, for a variety of purposes. For example, in the morning an adult, working as a tour guide assigned to meet a group of people arriving at the airport, could use the connector headgear to effectively and conveniently display a custom sign identifying himself as the tour guide. A sign displayed in this manner would immediately attract the attention of the arriving tourists and the guide would have his hands free to welcome the tourists or to hold literature for distribution to the tourists, etc.

In the afternoon, that adult's teenage son could borrow the same connector headgear for a sporting event he was going to attend at which he wanted to display a pennant and a balloon upon which his team's logo appeared. The teenager could disconnect the "tour guide" sign by simply pulling the sign's stem member out of the connector. The teenager could then attach another retainer to the headband which would grip another connector. Now there would be two connectors attached to the headband into which the boy could insert his pennant and balloon. The likely possibility that the stems of the pennant and balloon are of different diameters presents no problem in the ability of the connectors to securely connect the items to the headgear.

That evening, after the boy has returned from the game, that adult's young daughter could wear the connector headgear to her friend's birthday party. The daughter would like to wear flowers in her hair. Accordingly, she disconnects the pennant and balloon, attaches several more retainers and connectors to the headband, and inserts the short stems of several flowers into the connectors.

As used herein, the terms "display item" and "ornamental display item" are intended to include a wide variety of items which can be supported and displayed on a support stem member secured to the headband. Such items include, but are not limited to, balloons, flags, pennants, signs, flowers, mistletoe, pinwheels, specialty design items, badges, pins, sculptures, animal figures, as well as various types of ornamentation.

Other advantages and features of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
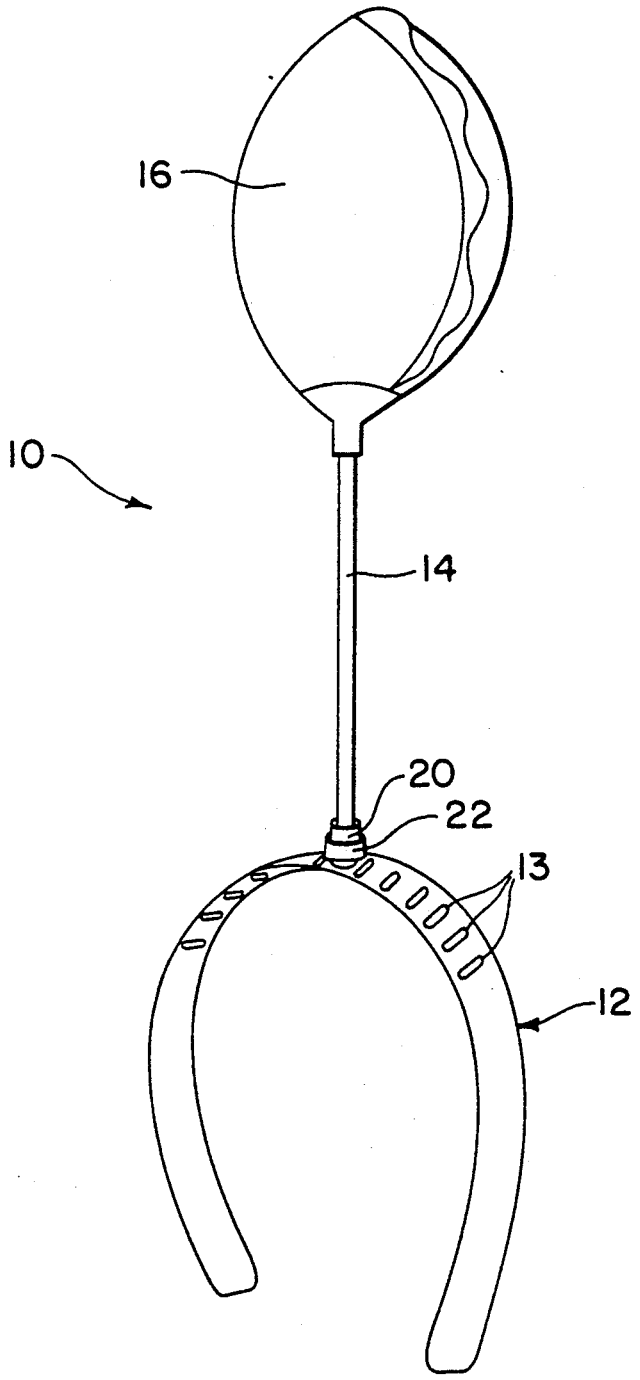
FIG. 1 is a perspective view of a preferred embodiment of connector headgear of the invention.
Figure 2:
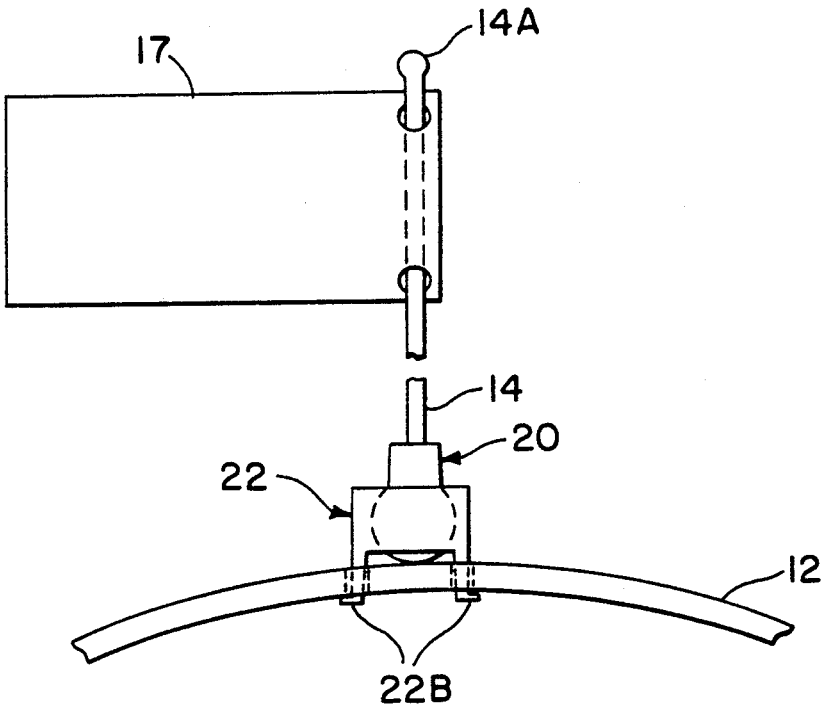
FIG. 2 is a front elevational view of a portion of the head gear shown in FIG. 1.

In FIGS. 1 and 2 there is illustrated a preferred embodiment of connector headgear device 10 of the invention comprising a U-shaped headband 12, an upstanding stem member 14 with a light-weight display item 16 (e.g., a balloon) carried by the stem, connector means 20 for detachably securing the lower end of the stem, and retainer means 22 for retaining the connector onto the headband.

Preferably the retainer 22 is detachably secured to the headband. It is also preferable for the headband to include a plurality of spaced apertures or slots 13 therealong so that more than one retainer 22, connector 20, and stem 14 may be included on a single headband. The presence of the multiple apertures or slots also enables a retainer 22 to be re-positioned on the headband at any desired location.

Preferably the retainer includes depending feet members 22A on opposite sides of the retainer. The feet members are adapted to extend into and engage adjacent apertures or slots 13 in the headband. Outwardly projecting toe portions 22B on the lower ends of feet 22A engage the underside of the headband and securely lock the retainer in place. When it is desired to disengage the retainer, it is only necessary to urge the feet members 22A towards each other until the toe portions 22B no longer catch the underside of the headband.

Figure 3:
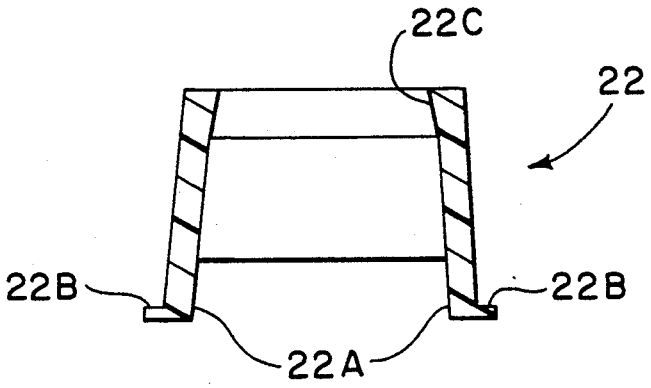
FIG. 3 is a cross-sectional view of the retainer means preferably used in the present invention.

Preferably the retainer 22 is in the form of a ring having an upper opening 22C which is slightly smaller in diameter than the opening at the lower end of the retainer. This feature (shown in FIG. 3) enables the retainer to retain the connector 20 on the headband.

Figure 4:
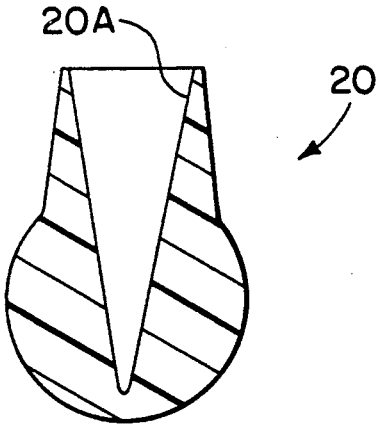
FIG. 4 is a cross-sectional view of a preferred type of connector means used in the present invention.

The preferred connector means 20 is shown in FIGS. 1 and 2 and is shown in cross-section in FIG. 4. The preferred configuration is a ball-shaped or spherical lower portion and a generally tubular upper portion. An opening 20A extends from the upper end nearly to the base of the spherical lower portion, as illustrated. In the preferred embodiment shown, the opening 20A has a conical shape so that the opening is able to accommodate stem members of different diameters (e.g., from 1/16 inch to ¼ inch, or even larger if desired). This is a very significant advantage which has not heretofore been available.

As illustrated in FIG. 2, a flag or pennant 17 may be carried by stem member 14, if desired. The upper end 14A of the stem may be enlarged, as shown, to assist in retaining the flag or pennant on the stem. Of course, other types of display objects light in weight may also be carried on the stem, if desired.

Connector means 20 preferably is composed of a compressible rubbery material which is also elastic. This feature enables the material to be stretched slightly when the lower end of a stem member is inserted into the conical opening 20A. The elastic and resilient nature of the material causes it to grip the lower end of the stem and hold it within the connector means 20. This type of composition is thus able to accommodate a variety of stem members having different diameters. This is a very significant advantage which has not heretofore been available.

Because the lower portion of the connector means 20 is spherical or ball-shaped, it can be rotated, tilted, or pivoted with respect to the retainer and the headband. This is a very significant advantage which has not heretofore been available.

Figure 5:
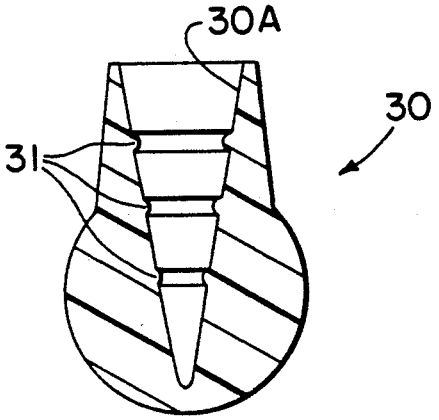
FIGS. 5–7 are cross-sectional views of other types of connector means which may be used in this invention.

FIG. 5 is a cross-sectional view illustrating another embodiment of connector means 30 having conical opening 30A. A plurality of parallel rings or ribs 31 are in horizontal planes within the opening to assist in gripping the lower end of a stem member which may be inserted into the opening. This type of opening is thus able to accommodate a variety of stem members having different diameters.

Figure 6:
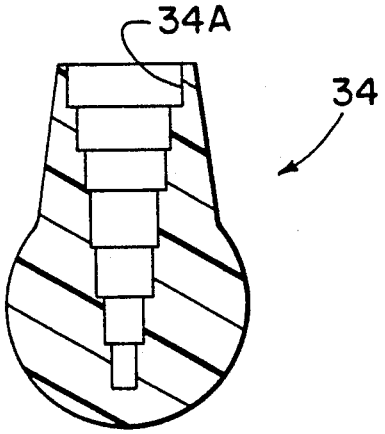

FIG. 6 is a cross-sectional view of another embodiment of connector means 34 having opening 34A therein. The opening 34A is stepped in a manner such that it becomes narrower with increasing depth. The width at the lower end is very narrow, while the width at the top is nearly equal to the diameter of the upstanding portion of the connector, as illustrated. This type of opening is thus able to accommodate a variety of stem members having different diameters.

Figure 7:
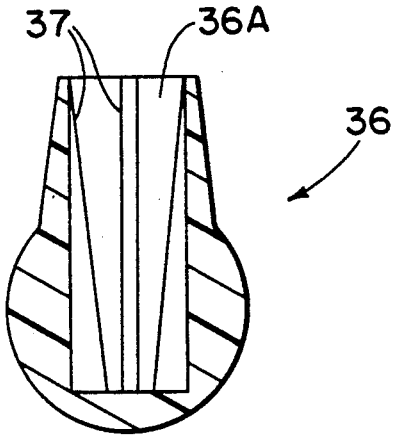

FIG. 7 illustrates another version of useful connector means 36 having opening 36A therein. In this embodiment the opening 36A is cylindrical. A plurality of tapered vertical ribs 37 are secured in the opening. As illustrated, the ribs 37 are wider at their lower ends than at their upper ends so as to accommodate stems of different diameters.

Figure 8:
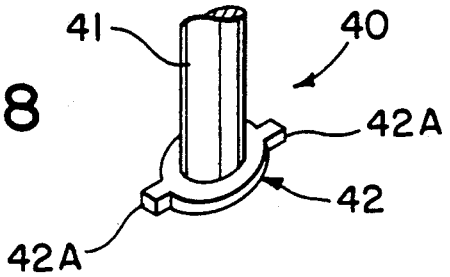
FIG. 8 is a perspective view of another type of attachment means which can be used in the present invention.

FIG. 8 is a perspective view illustrating the lower end of another embodiment of stem member 40. The stem 41 has secured to the lower end thereof a ring member 42. On opposing sides of the ring member there are projecting blades 42A, as illustrated. Such blades are adapted to be releasably secured in a complementary shaped ring holder carried on the headband.

Figure 9:
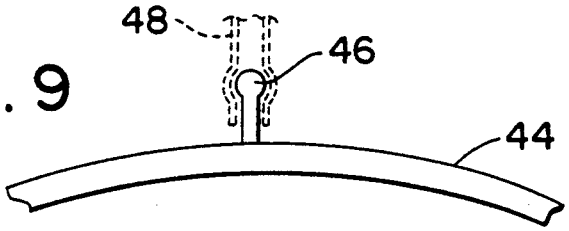
FIG. 9 is a front elevational view illustrating another type of attachment means which is useful herein.

FIG. 9 illustrates yet another version of the invention. In this embodiment the headband 44 includes one or more upstanding peg or post members 46 which have an enlarged head portion, as illustrated. Such post members serve as attachment means for stem members 48 (shown in dotted lines) which are tubular in construction or have an opening at their lower ends.

Figure 10:
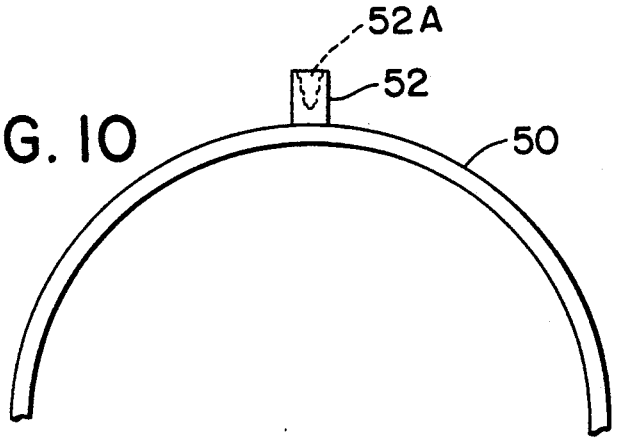
FIG. 10 is a front elevational view illustrating another embodiment of the invention.

FIG. 10 is a front elevational view illustrating another embodiment of the invention in which the headband 50 includes one or more attachment means 52, as illustrated, which comprise an outwardly projecting tubular member having an opening 52A therein. The opening may be conical in shape, or it may be a stepped opening (e.g., of the type illustrated in FIG. 6), or it may include horizontal or vertical ribs (e.g., of the type illustrated in FIGS. 5 and 7, respectively), or it may have other suitable configurations which are capable of receiving and releasably holding the lower end of a stem member therein.

Thus, the connector headgear of the invention enables a variety of light-weight display items to be worn or displayed on a headband. The types and number of light-weight display items can be readily changed as desired. Other variants are possible without departing from the scope of the invention. For example, the stem members may be composed of plastic, wood, metal (e.g., wire), or combinations of such materials. The types of light-weight display objects used may also vary, as described above. Combinations of different display objects may also be used, if desired.

What is claimed is:

1. Connector headgear comprising:

(a) a U-shaped headband for resiliently gripping the head of a wearer; wherein said headband includes a plurality of spaced apertures;

(b) at least one stem member having upper and lower ends, and further including a display item carried by said upper end;

(c) attachment means for detachably securing said lower end of said stem member to said headband; wherein said attachment means comprises:

(i) retainer means adapted to be detachably fastened to said headband; and (ii) connector means adapted to be retained by said retainer means; said connector means being further adapted to releasably secure said lower end of said stem member; wherein said connector means includes upper and lower portions; wherein said lower portion has a generally spherical shape; wherein said upper portion is generally cylindrical and includes an opening therein for receiving said lower end of said stem member;

wherein said retainer means can be unfastened from said headband, and said stem member can be disconnected from said connector means.

2. Headgear in accordance with claim 1, wherein said headband comprises plastic.

3. Headgear is accordance with claim 1, wherein said retainer means includes feet members which are received in said apertures in said headband to detachably fasten said retainer means to said headband.

4. Headgear in accordance with claim 1, wherein said opening in said connector means is conical.

5. Headgear in accordance with claim 1, wherein said opening includes an interior surface having spaced ridges thereon so as to accommodate stem members of different diameters.

6. Headgear in accordance with claim 5, wherein said ridges are in parallel horizontal planes.

7. Headgear in accordance with claim 5, wherein said ridges are vertical.

8. Headgear in accordance with claim 1, wherein said display item is selected from the group consisting of a balloon, a flag, sign, pennant, flower, badge, pinwheel, and mistletoe.

9. Connector headgear comprising:

(a) a plastic U-shaped headband for resiliently gripping the head of a wearer; wherein said headband includes a plurality of spaced apertures;

(b) at least one stem member having upper and lower ends, and further including a display item carried by said upper end;

(c) retainer means including feet members adapted to be received in said apertures for detachably fastening said retainer means to said headband;

(d) connector means adapted to be retained by said retainer means; said connector means being further adapted to releasably secure said lower end of said stem member; wherein said connector means includes upper and lower portions; wherein said lower portion has a generally spherical shape; wherein said upper portion is generally cylindrical and includes an opening therein for receiving said lower end of said stem member;

wherein said retainer means can be unfastened from said headband, and said stem member can be disconnected from said connector means.

10. Headgear in accordance with claim 9, wherein said opening in said connector means is conical.

11. Headgear in accordance with claim 10, wherein said opening includes an interior surface having spaced ridges thereon so as to accommodate stem members of different diameters.

12. Headgear in accordance with claim 11, wherein said ridges are in parallel horizontal planes.

13. Headgear in accordance with claim 11, wherein said ridges are vertical.

14. Headgear in accordance with claim 9, wherein said connector means is rotatable and pivotable with respect to said retainer means.

15. Headgear in accordance with claim 14, wherein said connector means is compressible and elastic.

* * * * *